United States Patent [19]

Anderson

[11] 3,988,834

[45] Nov. 2, 1976

[54] EGG MARKER

[76] Inventor: Robert J. Anderson, 8315 Dixboro Road, South Lyon, Mich. 48178

[22] Filed: Feb. 1, 1974

[21] Appl. No.: 438,779

[52] U.S. Cl. ..... 33/21 R; 33/26; 118/503

[51] Int. Cl.[2] ..... B43L 13/00

[58] Field of Search ..... 33/21 R, 21 D, 27 K, 33/27 L, 26; 118/503, 76

[56] References Cited

UNITED STATES PATENTS

| | | | |
|---|---|---|---|
| 236,432 | 1/1881 | Higbee | 33/21 D |
| 801,795 | 10/1905 | Koelsch et al. | 118/219 |
| 1,763,885 | 6/1930 | Fisher | 33/27 L |
| 1,768,615 | 7/1930 | Lane | 273/29 BE |
| 1,832,255 | 11/1931 | Springstead | 33/21 R |
| 1,982,304 | 11/1934 | Holden | 33/137 R |
| 2,270,177 | 1/1942 | Vawryk | 118/503 |
| 2,727,325 | 12/1955 | Jurinic | 118/503 |
| 3,358,644 | 12/1967 | Greene | 118/503 |
| 3,484,797 | 12/1969 | Barnett et al. | 33/21 R |

*Primary Examiner*—Richard E. Aegerter
*Assistant Examiner*—Michael H. Thaler
*Attorney, Agent, or Firm*—David A. Maxon

[57] ABSTRACT

Apparatus for marking eggs comprising parallel upstanding brace members fixed to a horizontal base; a rotatable element rotating in one of said brace members and operable to engage one end of an egg; another member yieldably urged against another end of the egg and operable to allow rotation of the egg with respect to the end of that member; a disc member fixed to said rotatable member; apertures near the peripheral edge of the disc member operable to pass over a corresponding aperture in said first brace member; a pin operable to pass through one of the apertures in said disc member therethrough into said corresponding aperture in said first brace member; a metal straight edge guide above and substantially parallel to the axis of the egg and substantially rigid; a sliding member operable to slide on said straight edge member along a line parallel to the central axis of the egg; an aperture vertically deposed in said slide member operable to hold a pencil; and a weight member having a central axis and an aperture along said central axis for engaging the top portion of the pencil; whereby pencilled marks on said egg can be selectively made by movement of the slide member and by movement of said disc with fixed positions determined by passing the pin through the disc to the corresponding aperture in the first mentioned upstanding brace member.

1 Claim, 4 Drawing Figures

EGG MARKER

This invention relates generally to egg markers. More particularly, this invention relates to an egg marker having rotatable and slideable elements for drawing circular lines as well as preselected straight lines on the surface of an egg.

In the art of egg crafting, it has been a practice in the past to mark appropriate delineations on an egg for cutting and decorative purposes with a variety of techniques. These techniques consisted, for example, of placing a rubber band around the egg in a position immediately adjacent the lines to be drawn and using the rubber band as a guide for a pencil in passing along the egg shell adjacent the rubber band. Another one of these techniques has consisted of using a tape measure or the like to wrap around the egg at the appropriate position adjacent where the designated line is desired to be drawn and then drawing a pencil along the egg adjacent the tape measure. In both of these methods the egg must be held manually as well as the tape measure resulting in imposition due to either the misplacing of the tape measure or the rubber band or to variations in the holding of the pencil during the drawing of lines. Such techniques have proved to be cumbersome and difficult and may result in the wasting of an expensive egg shell, particularly goose eggs or ostrich eggs or rhea eggs or emu eggs.

Accordingly, it is an object of this invention to provide an egg marker that holds an egg in a precise preselected position during the process of marking, that has predetermined precision paths for the moving of a marker such as a pencil; that allows for a predetermined rotation of the egg for different marking operations that can be precisely determined to predesignation portions of the egg, which is uncomplicated and inexpensive to make, use and distribute as well as to instruct in the proper use of the device.

These and other objects of this invention are achieved by the provision of an egg marker comprising a horizontal base member; a first upstanding vertically extending support member; a second upstanding vertically extending support member spaced at a distance away from the first mentioned support member and both of the support members being fixed at preselected positions and at a predetermined distance apart on the base member; a rotating member passing through the first support member and operable to rotate with respect thereto and having a surface that is operable to frictionally engage one end of an egg and to transmit rotary motion from a handle applied to the rotary member to the egg; another member operable to engage the other end of the egg and to allow rotation of the egg with respect to the other member and being yieldably urged towards engagement with that end of the egg and passing through the second support member; a straight edge member deposed in a substantially horizontal direction being supported by the support members and extending in a line substantially parallel to the central axis of the egg; a slide member operable to slide in a horizontal direction along the top of the straight edge member; an aperture in the slide member for holding a pencil; and a weight member applied to the end of the pencil to force the appropriate amount of force in a downward direction on the pencil during the process of marking.

These and other objects of this invention can be further appreciated from the following specifications and claims.

ON THE DRAWINGS

Figure 1:
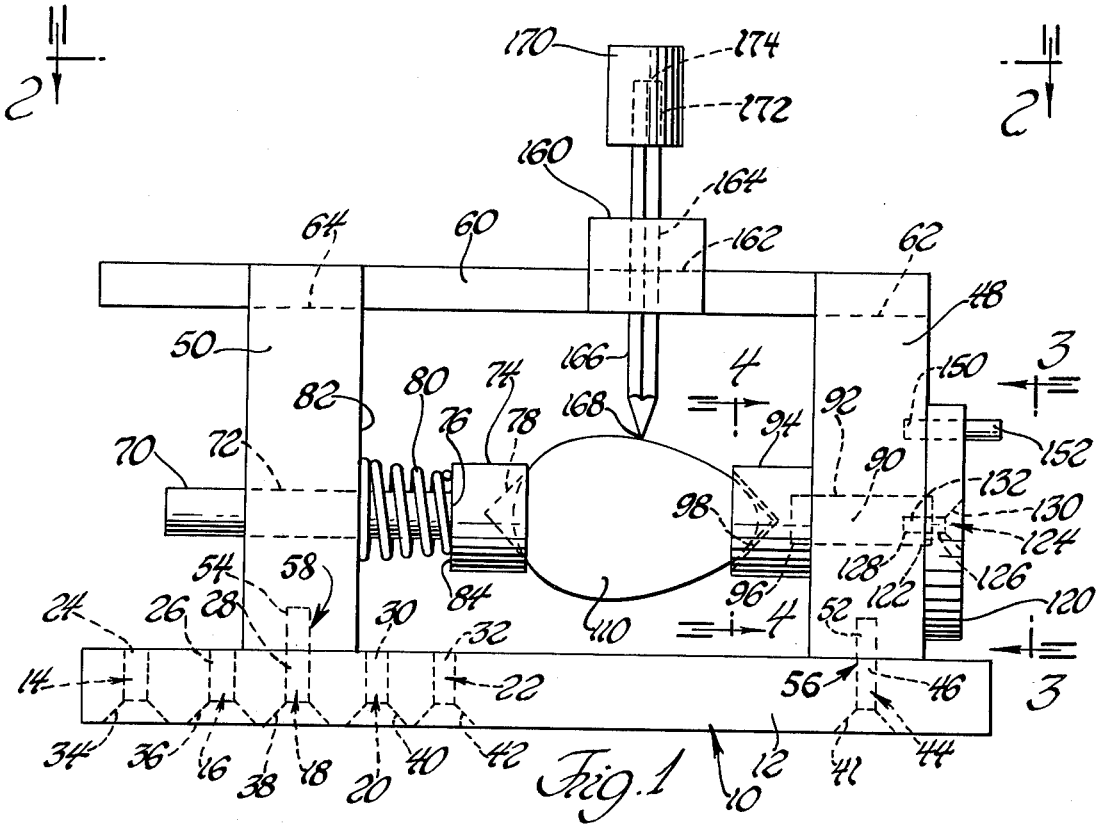
FIG. 1 is a side plan view of the preferred embodiment of this invention.
Figure 2:
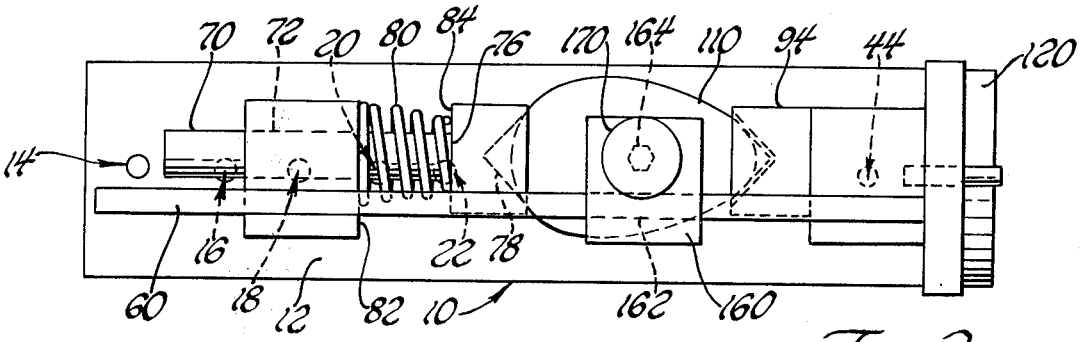
FIG. 2 is a transverse sectional view taken along the lines 2—2 of the apparatus shown in FIG. 1.
Figure 3:
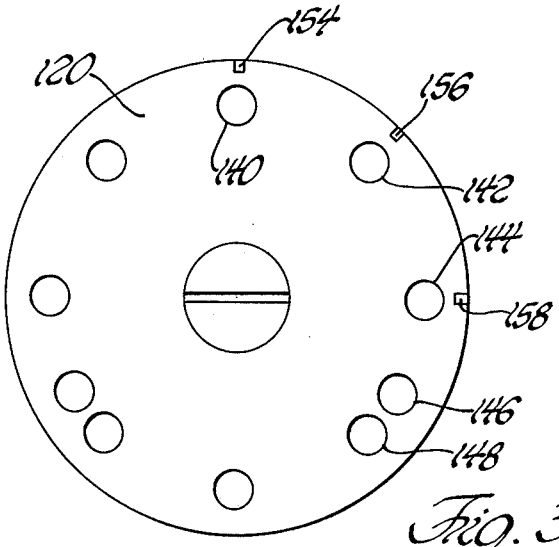
FIG. 3 is a view of the disc along the lines 3—3 of FIG. 1.
Figure 4:
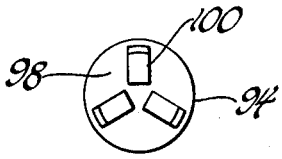
FIG. 4 is a view of the cup 94 along the lines 4—4 shown in FIG. 1.

Before explaining the present invention in detail, it is to be understood that the invention is not limited in its application to the details in construction and arrangement of parts illustrated in the accompanying drawings since the invention is capable of other embodiments and of being practiced or carried out in various ways.

Also, it is to be understood that the phraseology and terminology employed herein are for the purpose of description and not of limitation.

AS SHOWN ON THE DRAWINGS

The egg marker apparatus in its preferred embodiment is shown generally at numeral 10. A base supporting member 12 is preferably made of a canvas base phenolic resin plastic in laminated form such as that made by National Volk Company and distributed by F. B. Wright Company of Dearborn, Michigan. A plurality of apertures 14, 16, 18, 20, 22 are provided in the base member 12. Each of these apertures 14, 16, 18, 20, 22 has a top central shank portion 24, 26, 28, 30, 32 and a lower counter sunk portion of greater diameter with a corresponding co-axial central axis indicated by numerals 34, 36, 38, 40, 42 respectively. An additional aperture 44 near the opposite end of base member 12 is provided with an upper central shank portion 46 and a lower counter sunk portion 44 having a co-axial central axis and corresponding in shape and size to the aforementioned apertures 14, 16, 18, 20, 22.

Right and left upstanding vertically extending support members 48, 50 are secured to the right and left sides respectively of the base member 12 by means of threaded bolt members 52, 54 extending through apertures 44 and one of the apertures 14, 16, 18, 20, 22 into a threadably engaging aperture 56, 58 in support members 48, 50 respectively. Each of the support members 48, 50 are also made of a canvas base phenolic resin laminate being somewhat thicker than the laminate used in the base member 12. Preferably, the thickness of the vertical support members 48, 50 is of an order of magnitude at least twice as great as the thickness of the base member 12.

A straight edge member 60 is fixed to the top of the support member 48, 50 by engaging corresponding slots 62, 64 having the same thickness and slightly less depth than the thickness and width respectively of the straight edge member 60. The straight edge member is held in the slot 62, 64 in support members 48, 50 in what might be appropriately described as a loose press fit. The force generated by the friction of the size of the slots 62, 64 on the straight edge member 60 is less than the force required to manually disengage the straight edge from the slots by manually pulling upwardly on the straight edge member 60 while holding the base member 12 in place.

The straight edge member 60 is preferably made of an aluminum alloy such as SAE 6160. It may be cut off from a stock size ¼ × ½ inch such as that distributed by the Aluminum Company of America of Pittsburgh, Pa.

A shaft member 70 is in the shape of right circular solid cylinder and is preferably made of a canvas base phenolic resin such as that made by National Volk Company as distributed by F. B. Wright Company of Dearborn, Michigan and designated as rod stock ½ inch diameter. A corresponding aperture 72 is provided along a horizontal axis in support member 50 having a diameter slightly greater than the diameter of shaft 70 for engaging same and confining the translation of shaft 70 to a horizontal direction.

A knob member is press fitted onto the right end 76 of the shaft 70. The knob member 74 is in the shape of a right circular cylinder having a diameter approximately twice the diameter of the shaft 70 and having a central axis corresponding to the central axis of shaft 70. A counter sunk aperture 78 is provided on the right end of the combination of the shaft 70 and the knob member 74 such that the central axis of the counter sunk aperture 78 corresponds with the central axes of the knob member 74 and the shaft 70. The maximum diameter of the counter sunk aperture 78 is approximately 90% of the diameter of the knob member and the depth of the counter sunk aperture 78 is approximately three-quarters of the depth of the knob member 74.

A helically wound conically tapering coil spring member 80 is provided between the interior wall 82 of the support member 50 and the exterior wall 84 of the knob member 74 such that the maximum diameter side of the spring 80 engages wall 82 and the minimum diameter side of the coil 80 engages the surface 84. The spring 80 is preferably made of spring wire of a type well known to workers skilled in the art of spring manufacture. The spring 80 is biased towards full extension such that when the distance between wall 82 and wall 84 is reduced, the spring exerts a force against these respective walls trying to force a greater extension of the spring and consequently a greater distance between the walls 82 and 84.

The knob member 74 is preferably made of a paper based phenolic resin referred to as "Craft paper" by those skilled in the art such as that distributed by F. B. Wright Company of Dearborn, Michigan and referred to as rod stock 1 inch diameter.

A second shaft member 90 is in the shape of a right circular solid cylinder and is preferably made of a canvas back phenolic resin such as that made by National Volk Company and distributed by F. D. Wright Company of Dearborn, Michigan and designated as rod stock ½ inch. The shaft 90 is deposed along a horizontal axis substantially co-linear with the axis of shaft member 70 and shaft member 90 is enclosed within an aperture 92 that is a right circular cylindrical aperture in support member 48 with a common central axis as that of shaft 92 and having a slightly larger diameter to engage shaft 90.

A second knob member 94 is press fitted onto shaft member 90. An aperture 96 having a right circular cylindrical configuration and extending to a distance substantially less than the diameter of shaft member 90 and having a diameter substantially equivalent to shaft member 90 to allow a press fit engagement therewith.

A right circular conical aperture is provided on the interior side of knob 94 as indicated by numeral 98.

The central axis of conical aperture 98 is coincident with the central axes of knob 94 and shaft 90 and also coincident with the corresponding conical aperture 78, and the central axis of shaft 70 and first knob 74.

A plurality of rubber strips 100 are and radially arrayed on the surface of the counter sunk aperture 98. The surface of the rubber strips 100 that engage the counter sunk aperture surface 98 are fixed thereto by means of an epoxy resin to provide a rigid and secure adherence thereto. The opposite sides of the rubber strips 100 are operable to frictionally engage the surface of an egg held between the knobs 74, 94 for preventing rotation of the egg 110 with respect to the shaft 90 while allowing rotation of the egg 110 with respect to the shaft 70.

A disc member 120 is a right circular cylindrical disc having a right circular cylindrical aperture 122 on the left side thereof having a diameter in the aperture 122 corresponding to the diameter of shaft 90 for a press fit engagement therewith fixing the disc 120 to the shaft 90. An aperture 124 is provided within the disc 120 and has an extended shank portion 126 on the left side thereof communicating with and corresponding to extended shank portion 128 in the shaft 90 having a common co-axial central axis therewith. A counter sunk portion 130 on the right side of the disc is provided with a central axis coincident with the axis of extended shank portions 124, 126. A bolt is provided in the aperture 124, 126, 128. This bolt is designated by numeral 132 and has a threaded shank portion engaging the extended shank portions 124, 126 for fixedly securing the disc member 120 to the shaft member 90.

A plurality of right circular cylindrical apertures 140, 142, 144, 148 are provided passing all the way through the disc member 120. A corresponding aperture having the same shape, that is a right circular cylindrical surface extending part way through the right side of support member 48 and having a corresponding central axis with the aperture 148 is designated by numeral 150. A pin 152 is operable to be slid through any one of the apertures 140, 142, 144, 148, and when such a pin is extended through such an aperture such as the aperture 148 located at the topmost location, it may be passed through such an aperture 148 through the aperture 150 to engage the aperture 150.

It should be noted that the disc member 120 is made of a canvas back phenolic resin laminate such as that made by National Volk Company and distributed by the F. B. Wright Company of Dearborn, Michigan and designated as sheet stock ⅜ inch.

It should be noted that when the pin, which is preferably made of wood dowel rod, has a diameter of ¼ inch being slightly smaller but very slightly smaller than the diameter of the apertures 140, 142, 144, 146, 148, 150 so that there is a slip fit.

A plurality of marks are provided in color coding on the periphery of disc 120 designated by the numerals 158, 154, 156 which can correspond to particular colors such as red, blue and yellow respectively. Each of the plurality of the apertures 140, 142, 144, 146, 148 have appropriate color coded designated from one or more of the color code designations 158, 154, 156 printed on the periphery of the disc adjacent such a hole for precisely determining rotation of the disc and consequently the rotation of the egg 110 through precisely determined halfs, thirds, quarters and eighths.

A slide member 160 is essentially a block of canvas backed phenolic resin such as that made by National Volk Company and distributed by the F. B. Wright Company of Dearborn, Michigan and designated as sheet stock 1¼ inches. A slot portion 162 having a thickness and depth corresponding to the thickness and width of slide member 160 is provided so that the slide member 160 is operable to slide without any noticeable wobble along the straight edge member 60. A central aperture 164 having a right circular cylindrical configuration extending from top to bottom of the slide member 160 and having a central axis intersecting the central axes of shafts 70 and 90 is provided. The diameter of this aperture 164 is approximately 5/16ths of an inch and is operable to hold an ordinary hexagonally shaped exterior of a No. 2 pencil. The pencil is designated by numeral 166 with the tip 168 of the pencil 166 engaging the exterior surface of an egg 110 held in the apparatus 10. A weight member 170 is made of a wooden dowel of approximately 1 inch diameter that has a central aperture 172 of ⅜ths of an inch diameter provided to engage the top end 174 of the pencil 166 and exerts an additional weight downwardly on the pencil 166 for the engagement of the point 168 onto the surface of the egg 110 to provide desirable marking characteristics.

OPERATION

In the operation of the preferred embodiment of this invention, an egg 110 is placed between the first and second knobs 78, 98. A pencil 166 with a weight member 170 attached thereto is passed through aperture 164 and slide member 160 so that the tip of the pencil 168 engages the top surface of the egg 110. In the preferred initial position of the apparatus, the pin 152 passes through aperture 148 in disc member 120 into corresponding aperture 150 for fixing the disc with respect to preventing any motion thereof with respect to the support member 48. It can be appreciated that with the apparatus conditioned for operation as immediately above described, the pencil can draw a line within a single plane across the surface of the egg 110 by simply sliding the slide member 160 with respect to the straight edge member 60. If it is desired to draw another line member at exactly 120° with respect to the first line drawn, the pin is removed from the apertures and the disc is rotated for the corresponding color corresponding to a one-third rotation so that the new hole will be in the position of where the hole 148 previously was and a pin is inserted therethrough through the aperture in like manner so that the pencil can then be drawn across the surface of the egg by sliding the slide member 160 in drawing the second line. In a similar manner, similar predetermined precise ordinal fractions of the circumference of the egg can be divided by drawing of appropriate lines by simply rotating according to the color coded indication.

If it is desired to make a circular arc around the egg, the pin is removed from the aperture, the pencil is placed exactly on the point on the egg from which it is desired to start the circular arc, and the pin is put into one of the apertures 140, 142, 144, 148, but not through the corresponding aperture 150 such that rotation applied to the pin will rotate the disc and consequently rotate the knob 94 which frictionally engages the end of the egg 110 through rubber strips 100 to transfer the rotation applied to the disc 120 to the egg 110 and thereby rotating the egg through the arc desired up to and including a full 360° rotation or any fraction thereof as desired.

It can be further appreciated that a variety of sized of eggs may be utilized for marking with the present device by simply spacing the support member 50 either further or closer away from the support member 48 by using a different one of the apertures 14, 16, 18, 20, 22 for passing a bolt therethrough to secure the support member 50 in the desired position with respect to the base member 12.

It can be further appreciated from the foregoing description of the operation structure of the preferred embodiment of this invention, that a substantially equal or only slightly greater force is exerted from one size of an egg to another due to the conical decreasing of the circumference of the coils of the spring member 80 with the smallest diameter of such coils being that nearest the egg. Consequently a non-linear and slower than linear accretion of force of the spring against the egg is achieved when larger eggs are used and a corresponding distance is achieved between the surfaces 84 and 82 of knob member 74 and support member 50 respectively.

I claim:

1. In egg marking apparatus the improvements comprising:

a horizontally extending base supporting member;

a first upstanding vertically extending support member;

a second upstanding vertically extending support member;

said first and second vertically extending support members fixed to said horizontal base supporting member;

a first shaft member operable to rotate within a corresponding aperture in said first vertically extending support member;

a second shaft member co-axial with said first shaft member and operable to pass through an aperture in said second upstanding vertically extending support member;

a first knob member fixed to said first shaft member and having a recessed portion operable to engage the end surface of an egg;

rubber strips fixed to said first knob member and operable to frictionally engage an end of said egg;

a second knob member fixed to said second shaft member having a recessed portion operable to extend to the other surface of the egg;

a helically wound coil spring resisting compression and urging force against the right hand side of said second upstanding vertically extending support member and the left hand side of said second knob member and wherein the diameter of the coils in said spring member is greater than the diameter of said second shaft member to exhibit a substantially helical shape and wherein a portion of said coils engages said second knob member and another portion of said coils engages said second upstanding vertically extending support member;

a plurality of apertures in said horizontally extending base supporting member near said second upstanding vertically extending support member;

a threadably engaging aperture in said second upstanding vertically extending support member;

a threaded bolt member capable of extending through any of said plurality of aperture and into said threadably engaging aperture thereby securing said second upstanding vertically extending support member to said horizontally extending base supporting member at a plurality of positions;

a guide member fixed to said vertically upstanding support members and spaced at a distance above and laterally displaced from the central axis of said shaft member;

a slide member mounted on said guide member by a slot portion laterally displaced from the center of said slide member, and operable to allow said slide member to slide on said guide member;

an aperture extending vertically through said slide member proximate the center thereof;

a marker member extending through said aperture in said slide member and operable to engage an egg held between said first and second knob members;

a disc member fixed to said first shaft member;

apertures in said disc member corresponding to preselected ordinal fractions of full rotation of said first shaft member;

a corresponding aperture co-axial with one of said apertures in said disc member, said corresponding aperture communicating with any one of said apertures in said disc at a predetermined location and said corresponding aperture being in said first upstanding vertically extending support member;

a pin member operable to mutually engage one of said apertures in said disc member and said corresponding aperture in said first upstanding vertically extending support member.

* * * * *